US005740966A

United States Patent [19]

Blaha-Schnabel

[11] Patent Number: 5,740,966

[45] Date of Patent: Apr. 21, 1998

[54] NEBULIZER NOZZLE

[75] Inventor: Ales Blaha-Schnabel, Nürnberg, Germany

[73] Assignee: Paul Ritzau Pari-Werk GmbH, Starnberg, Germany

[21] Appl. No.: 760,911

[22] Filed: Dec. 6, 1996

Related U.S. Application Data

[63] Continuation of Ser. No. 358,888, Dec. 19, 1994, abandoned.

[30] Foreign Application Priority Data

Dec. 17, 1993 [EP] European Pat. Off. ..... 93120417

[51] Int. Cl.[6] ..... B05B 7/04

[52] U.S. Cl. ..... 239/424.5

[58] Field of Search ..... 239/422, 433, 239/424.5, 416.5, 416.4, 338; 128/200.14, 200.21

[56] References Cited

U.S. PATENT DOCUMENTS

| | | | |
|---|---|---|---|
| 2,419,365 | 4/1947 | Nagel | 239/403 X |
| 2,984,420 | 5/1961 | Hession | 239/424 X |
| 2,984,421 | 5/1961 | Hession | 239/424 X |
| 3,512,719 | 5/1970 | Phelps et al. | 239/405 |
| 3,578,246 | 5/1971 | Davis | 23/424.5 X |
| 3,717,306 | 2/1973 | Hushioh | 239/424 X |
| 3,770,209 | 11/1973 | Wilcox . | |
| 4,278,418 | 7/1981 | Stenkert | 239/424.5 X |
| 4,479,773 | 10/1984 | Tamai | 239/405 X |

FOREIGN PATENT DOCUMENTS

| | | | |
|---|---|---|---|
| A-343 103 | 11/1989 | European Pat. Off. . | |
| A-31 45 390 | 11/1981 | Germany . | |
| U-91 11 596 | 9/1991 | Germany . | |
| 460118 | 7/1949 | Italy | 239/403 |
| A-1 547 857 | 3/1988 | U.S.S.R. . | |

*Primary Examiner*—Kevin Weldon

*Attorney, Agent, or Firm*—Merchant, Gould, Smith, Edell, Welter & Schmidt, P.A.

[57] ABSTRACT

A nebuliser nozzle is described for nebulising a pulverous or liquid nebulising material, especially for the inhalation therapy, comprising a nozzle body consisting of a nozzle insert member (1) and a nozzle receiving member (2) for receiving the nozzle insert. The nozzle insert member (1) comprises a contact surface (11) and a channel (13) for the supply of the nebulising material. The nozzle receiving member (2) has a receiving surface (21) on which the contact surface (11) of the nozzle insert member (1) rests, channels (22) for the supply of a compressed air and a mixing chamber (23) into which the channel (13) for the nebulising material and the channels (22) for the compressed air open out.

15 Claims, 5 Drawing Sheets

NEBULIZER NOZZLE

Figure 1A:
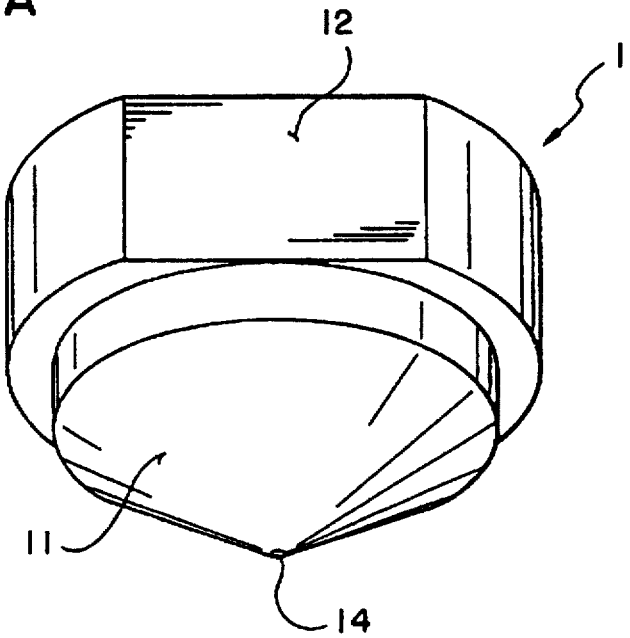

This is a Continuation of application Ser. No. 08/358,888, filed Dec. 19, 1994 now abandoned.

The present invention relates to a nebuliser nozzle for inhalation purposes, with which a pulverous or liquid nebulising material, preferably in the form of a solution or suspension, is nebulised.

Increased demands are placed on nebuliser nozzles for producing an aerosol for therapeutic purposes. The therapeutic quality of the aerosol is of particular significance, according to which an aerosol is to be produced which contains a largest possible portion of respirable particles ($\theta<8$ μm). Furthermore, the nebuliser nozzle must be capable of being cleaned in a simple manner and free of residues, which means that the nebuliser nozzle must also be dismantled without any great difficulties. In spite of numerous different structural forms, two groups of nebulisers present themselves which operate according to different principles.

A first group of nebuliser nozzles works according to the Venturi principle. A nozzle of this kind is known for example from DE 32 38 149 A1. Through a central compressed gas channel, compressed air is supplied, which emerges in a mouth plane through an opening of the central channel. Besides the compressed gas channel, usually a plurality of suction channels are provided which extend from the mouth plane to inside a container for the nebulising material. The nebulising material is drawn in through the suction channels by the emerging compressed gas and emerges from openings of the suction channels into the mouth plane. The openings of the compressed gas channel and the suction channels are adjacent, so that compressed gas and nebulising material are intensively mixed and the turbulences occurring ensure a nebulisation. With nebuliser nozzles of this construction, aerosols are produced in which the primary dispersion contains aerosol particles having a diameter of up to 40 μm. For this reason, besides independent desiccation of the aerosol, which is ensured by a sufficiently large amount of air, a subsequent treatment of the aerosol is necessary; this includes for example the precipitation of excessively large particles from the aerosol by constructive measures. The precipitated nebulising material is fed back into the container and can be nebulised anew. In several cases, the circulation of the nebulising material presents no problems. However, numerous medicaments are not suitable or are only poorly suitable for this kind of nebulisation, since an impairment of the effectiveness of the medicament must be reckoned with. Furthermore, a comparably large amount of the nebulising material must be available in order to permit the intake of the nebulising material through the suction channels. Moreover, excessively large residual amounts remain in the nebuliser, since, due to the construction, the nebulising material can never be entirely used up. In addition, the medicament is increased in concentration due to the evaporation of the solvent, which is connected with a change of the physical properties of the solution and the directly or indirectly resultant negative influence on the dispensing of the medicament. Several very expensive medicaments are not applied in the scope of an inhalation therapy for these reasons, although the medicaments are well suited for this kind of application.

In a further group of nebuliser nozzles, air and nebulising material are supplied under pressure, i.e. actively. Nebuliser nozzles of this kind are known for example from the DE 26 46 251 A1 and DE 28 23 643 A1. The basic construction of nebuliser nozzles of this group can be further taken from "Atomization and Sprays" by Arthur L. Lefebvre. Characteristic structural forms are differentiated in this connection on the basis of the type and the place of the occurring nebulising process, and namely on the one hand so-called "air-assist" nozzles with mixing inside or outside the nozzle body and so-called "prefilming" nozzles. These nebuliser nozzles have a common principle of construction to the extent that annular channels are arranged concentrically around a central channel. This leads to a complex construction and partially to considerable clearance volumes inside the nozzle body. For this reason, the nebuliser nozzles can only be conditionally dismantled or only under large expenditure. For example, the nozzle body of the nebuliser nozzle known from the DE 26 46 251 A1 consists of six elements, five of which have a central opening in relation to which the elements must be aligned in such a manner that the openings are coaxially arranged. The nebuliser nozzle, which is a case of a "prefilming" nozzle, is not suitable for repeated dismantling and cleaning on account of the problems involved with the alignment of the elements. Furthermore, this known nebuliser nozzle has a considerable clearance volume, since the slit space producing the thin film of liquid is surrounded by a much larger annular space on all sides, which also applies for the nozzle known from the DE 28 23 643 A1. However, this structure is necessary in order to feed the nebulising material through the slit space in such a manner that a thin film of liquid enters on all sides into the centrally conducted gas stream.

From the DE-U-91 11 596, a spray nozzle for spraying liquid melt adhesive by means of compressed air is known. A construction is disclosed wherein an externally conical nozzle tip, which centrally comprises a channel for the melt adhesive, rests against the internally conical surface of an air head. In the conical outer face of the nozzle tip, grooves are provided in a spiral fashion at an angle to the nozzle axis, which form compressed air channels together with the internally conical surface of the air head. All the channels open into an air chamber, which releases the melt adhesive in a bundled jet through a small air channel. Since the bundling of the rotary jet of the nozzle is intended, a fine nebulisation is not achieved.

Proceeding from this prior art, the invention is based on the object of providing a nebuliser nozzle for inhalation purposes with which an aerosol with a largest possible portion of respirable particles can be produced, and which nevertheless is easy to handle, especially easy to dismantle and clean, and which can be manufactured simply and economically (mass production article).

This object is solved by a nebuliser nozzle comprising the features given in patent claim 1. Further advantageous configurations can be taken from the subclaims.

Figure 1B:
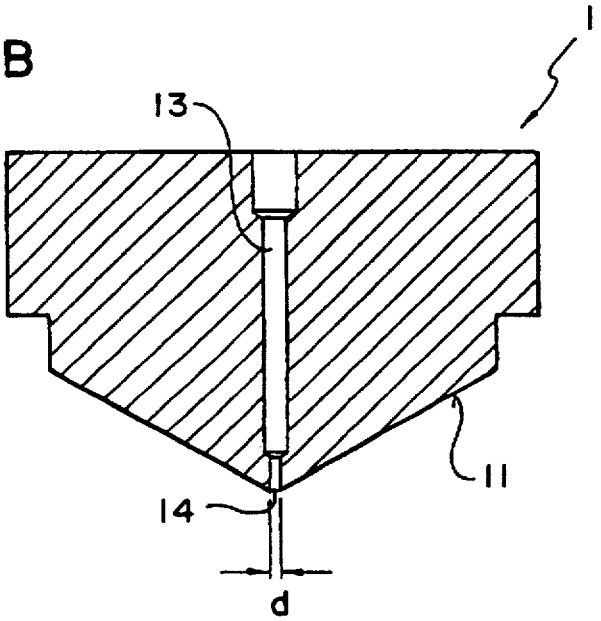
Figure 3:
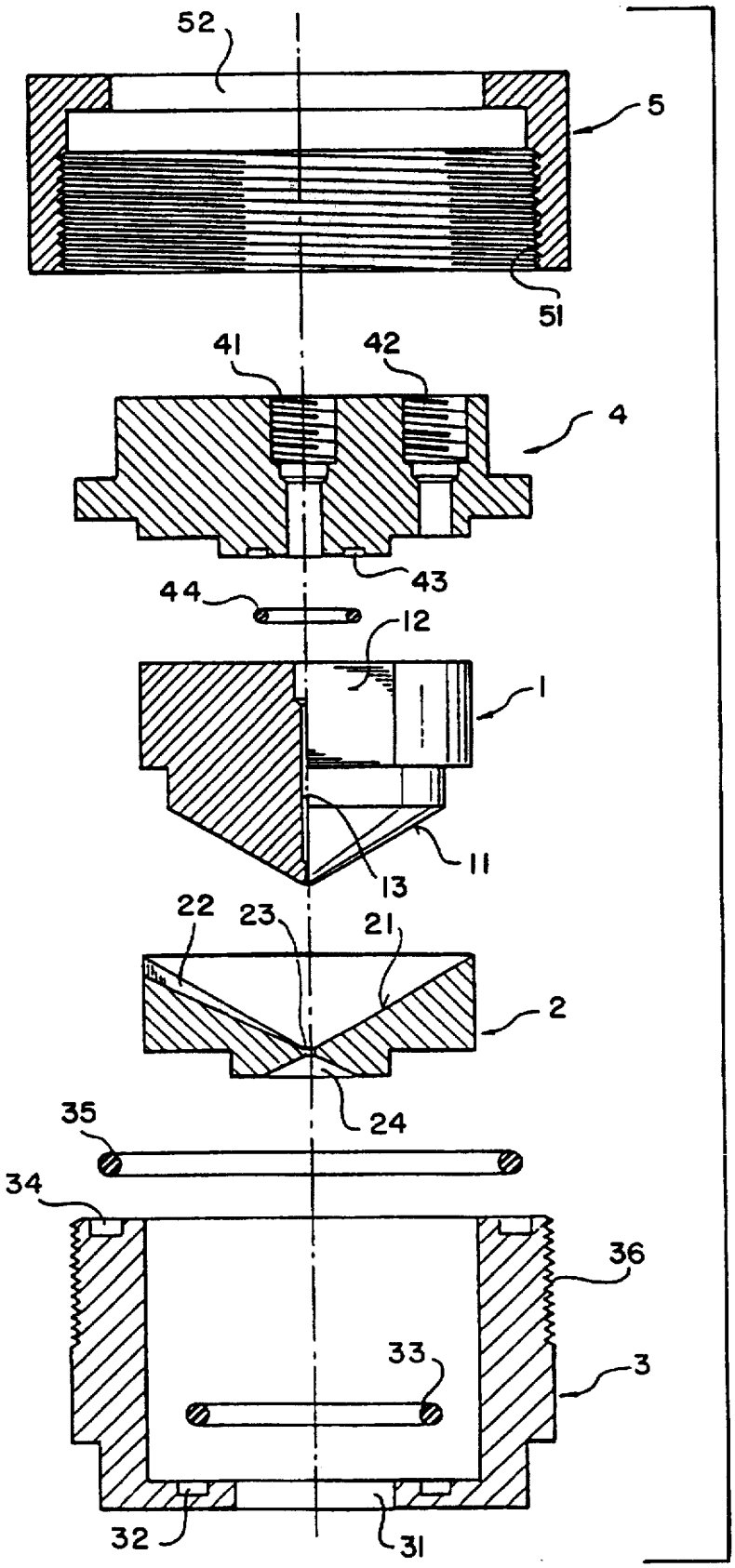
Figure 4:
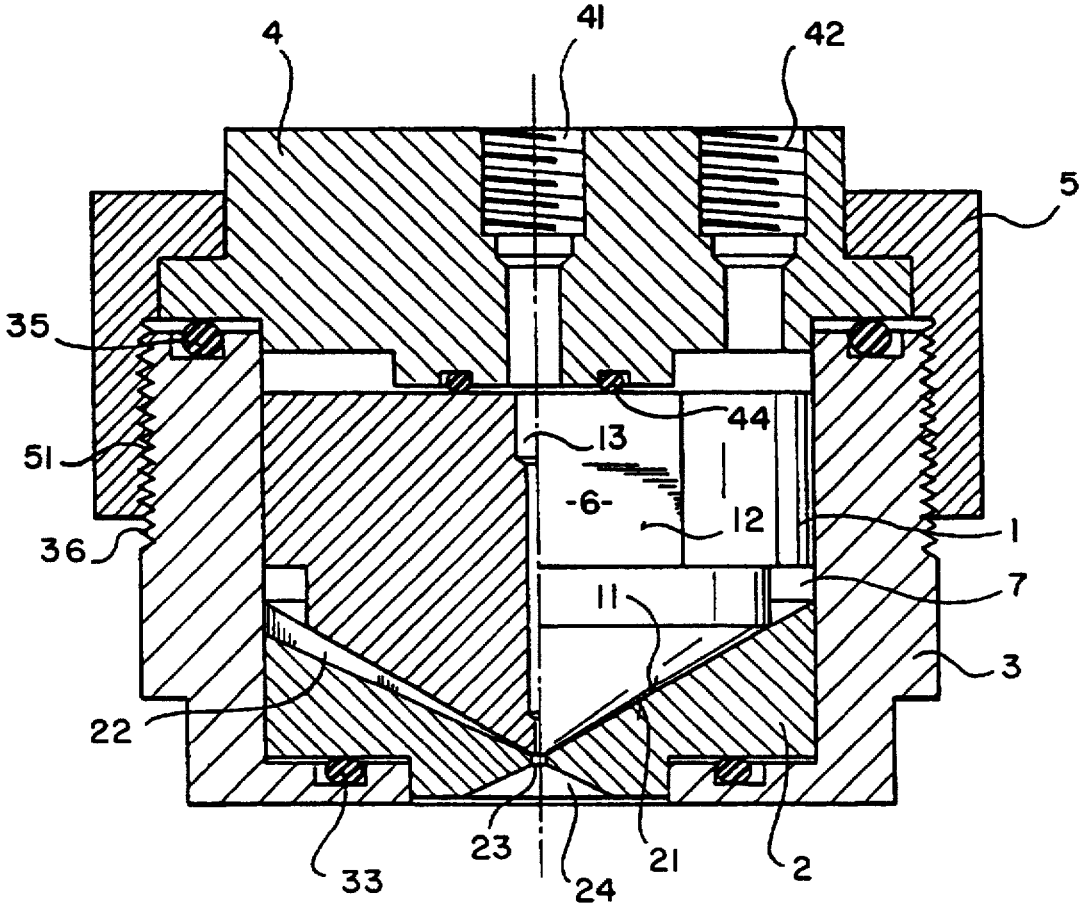
Figure 5:
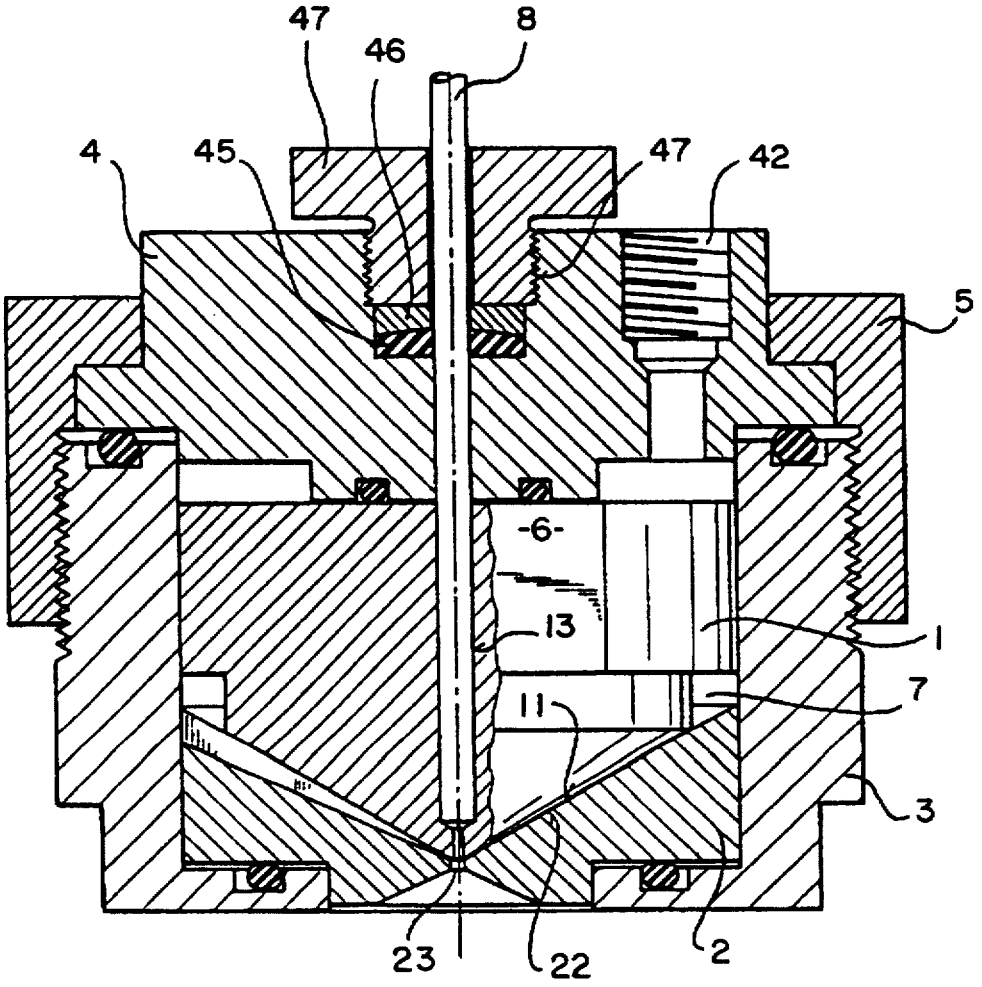

In the following, the invention is described in more detail on the basis of a preferred embodiment and with reference to the enclosed drawings. The drawings show:

FIG. 1 a perspective and a sectional representation of the nozzle insert member of a nebulising nozzle according to the invention;

FIG. 2 a perspective and a sectional representation of the nozzle receiving member of a nebuliser nozzle according to the invention;

FIG. 3 the further components of an embodiment of a nebuliser nozzle according to the invention;

FIG. 4 the embodiment of a nebuliser nozzle according to the invention of FIG. 3 in the assembled state, and FIG. 5 a further embodiment of the nebuliser nozzle according to the invention, which has a nebulising material connection of minimum clearance volume.

In the embodiment described in the following, the nebuliser nozzle according to the invention includes a plurality of members which are represented in FIG. 3. Of essential significance is the configuration of the nozzle body, which has two parts, the nozzle insert member 1 and the nozzle receiving member 2.

In FIG. 1 the nozzle insert member is represented; Part A of the Figure shows the nozzle insert member 1 in a perspective representation, Part B in a sectional representation. The basic form of the nozzle insert member 1 is composed of two flat circular cylinders having different diameters and a circular cone, the maximum diameter of which corresponds with the smaller circular cylinder. The circular cone defines a contact surface 11 of the nozzle insert member 1. The two circular cylinders and the circular cone are arranged axially to each other. The larger circular cylinder is flattened on its periphery at two opposite positions 12, only one of which is visible in FIG. 1A. In the nozzle insert member 1, a channel 13 is provided centrally for the nebulising material, which extends in the longitudinal direction of the basic form of the nozzle insert member 1 in such a manner that the outlet opening 14 lies at the tip of the contact surface 11. The outlet opening 14 defines the smallest diameter d of the channel 13 and thus its outlet cross-sectional area $A_Z$; the channel 13 has a diameter which increases stepwise.

Figure 2A:
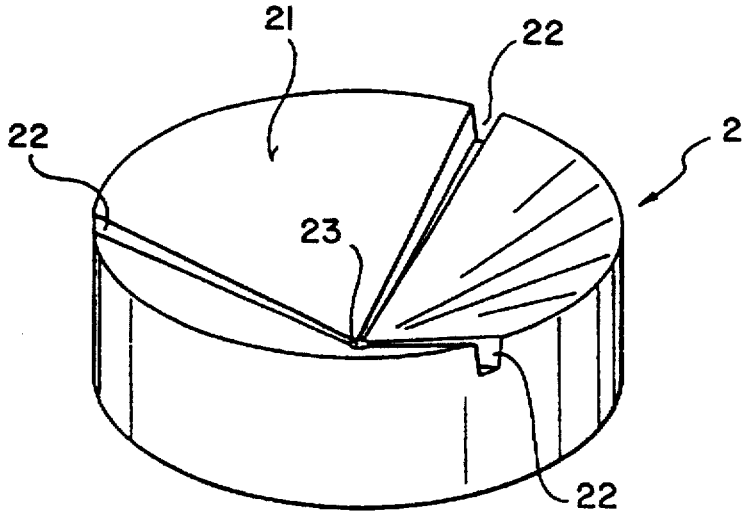
Figure 2B:
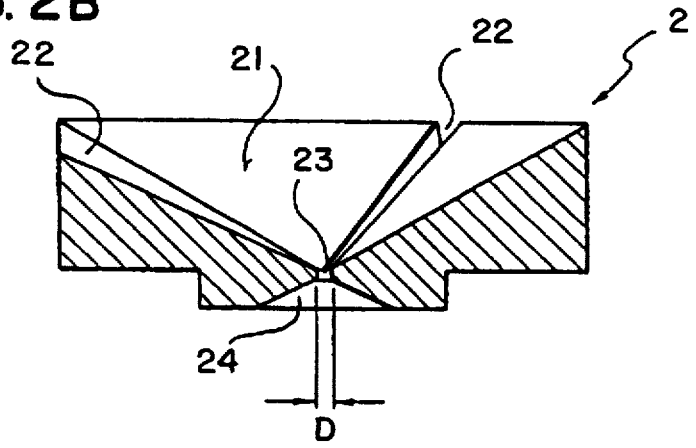

The FIGS. 2A and 2B show the nozzle receiving member 2 in perspective and sectional representation, respectively. The basic form of the nozzle receiving member is formed by two flat circular cylinders which are arranged axially to each other. The free end face of the larger circular cylinder has a concentric circular-cone depression that defines a receiving surface 21, which is adapted to the form of the contact surface 11 of the nozzle insert member 1. In the receiving surface 21, three channels 22 for the compressed gas are formed which extend radially to the center of the flat circular cylinder, and thus follow the inclined receiving surface 21 of the circular-cone depression. The channels 22 are distributed uniformly over the periphery of the nozzle receiving member 2 so that an angle of 120° is respectively provided therebetween, and taper towards the center of the nozzle receiving member. With respect to the channels 22 for the compressed gas, these are grooves in the receiving surface 21 with rectangular or trapezoidal cross-section and a minimum cross-sectional area $A_D$ at the end of the mouth.

The channels 22 for the compressed gas end in a cylindrical mixing chamber 23 which extends coaxially to the flat circular cylinders of the nozzle receiving member 2. On the side lying opposite the depression, the mouth area 23 opens into a circular-cone shaped outlet funnel 24.

In FIG. 3, besides the nozzle insert member 1 and the nozzle receiving member 2, further members of the embodiment of the nebuliser nozzle according to the invention are represented. A cylindrical housing 3 serves for receiving the nozzle body, i.e. the nozzle insert member 1 and the nozzle receiving member 2 in the sequence shown in FIG. 3. The inner diameter of the housing 3 corresponds to the diameter of the respectively larger, flat circular cylinder of the two parts 1 and 2 forming the nozzle body which, through a completely opened end face of the housing 3, can be brought into its interior. The opposite end face of the housing 3 merely has an opening 31 for receiving the smaller, flat circular cylinder of the nozzle receiving member 2. A circular groove 32 for receiving an O-ring 33 is provided inside on the end face of the housing 3 surrounding the opening 31. Furthermore, a groove 34 is provided for receiving a further O-ring 35 on the end face of the housing 3 opened to receive the nozzle body, in the housing wall. On this side, an external thread 36 is formed on the housing 3.

A lid 4 serves on the one hand to close the housing 3, and on the other hand comprises connections for the supply of the nebulising material and the compressed gas. The lid 4 has a cylindrical basic form with an axially arranged hole 41 for the supply of the nebulising material and an eccentrically arranged hole 42 for the supply of compressed air. A portion of the lid has a diameter which is sufficient to seal off the interior of the housing 3 in interaction with the O-ring 35. On the side of the lid 4 facing the nozzle insert member 1, two flat circular cylinders of smaller diameter are provided; in the surface of the smaller circular cylinder a circular groove 43 is formed for receiving an O-ring 44. The larger of the two diameters serves for guiding the lid 4 into the housing 3. With the three O-rings 33, 35, 44, there is a complete separation of the gas and liquid parts within the nozzle.

A screw cap 5 serves to secure the parts inserted in the housing 3, and in this respect has a thread 51 on an inner peripheral surface. In the opposite end face, an opening 52 is provided which ensures the access to the connection holes 41 and 42 in the lid 4.

FIG. 4 shows the embodiment of the nebuliser nozzle according to the invention in assembled state. The nozzle body, i.e. the nozzle insert member 1 and the nozzle receiving member 2 are arranged in the housing 3. The circular-cone shaped contact surface 11 of the nozzle insert member 1 rests on the receiving surface 21 of the nozzle receiving member 2 which is of complementary formation. Via the lid 4, the screw cap 5 and the housing 3, the two members forming the nozzle body are braced against each other, which ensures a good fitting of the nozzle insert member in the nozzle receiving member and an alignment of the outlet opening 14 with respect to the mixing chamber 23. The channels 22 formed as grooves in the receiving surface 21 are closed on their upper side, which was originally open, by the contact surface 11 of the nozzle insert member 1. The compressed air supplied through the eccentric connection hole 42 in the lid 4 arrives via the space 6 resulting at the flattened positions 12 of the nozzle insert member 1 in the housing 3 into the annular space 7 which is formed around the flat circular cylinder with smaller diameter of the nozzle insert member 1. The compressed air flows from there through the three channels 22 into the mixing chamber 23.

FIG. 5 shows a further embodiment of the nebuliser nozzle according to the invention in assembled state. The construction corresponds in many points with the previously described embodiment, so that reference can be made to the description thereof. In the following, the differences are explained by which the two embodiments are distinguished.

In the embodiment shown in FIG. 5 for the nebulising material the nozzle insert 1 has a channel 13 with a diameter which is constant with the exception of a portion in the region of the outlet opening 14. This diameter is selected such that a flattened cannula can be inserted and thus the clearance volume can be minimized. The outlet with the smallest diameter d is kept as short as possible for cleaning reasons.

The axial hole 41 is formed in the lid 4 in such a manner that a rubber disc 45 with a concentric hole can be inserted for the cannula 8. An intermediate ring 46 is arranged thereover, which on the side of the rubber disc 45 is formed inwardly to be slightly conical, preferably at an angle of 160°. By means of a pressure screw 47 receiving the cannula axially, the cannula is arrested after complete insertion in the channel 13 by tightening the pressure screw, and is sealed off against the environment.

The diameter of the mixing chamber 23 is of such dimension that its free cross-section equals approximately the sum of the free cross-sections of the channels 22 for the compressed gas at the outlet in the mixing chamber 23 in order to utilize the energy of the supplied compressed air to an optimal extent. If the cross-section of the mixing chamber 23 is too large, there is a premature relaxation, if it is too small, there is a damming up of the compressed air.

It is endeavoured to achieve an optimal utilization of the conversion of the pressure difference between compressed gas and ambient pressure into kinetic energy in the region of the outlet openings of the channels 22. In this respect, the distance between the liquid emerging from the channel 13 and the outlet openings of the channels 22 for the compressed air plays a decisive part. The length of the mixing chamber is approximately the same as its diameter. If the mixing chamber were to be too short, difficulties in the manufacturing technique would result with respect to the necessary channel depth in the mouth area. If the mixing chamber is too long, an impairment of the nebulisation efficiency by impaction and friction can result along with a tendency toward blockage.

On the basis of these considerations, it was determined that according to the invention the following dimensional ratios are to be maintained. The cross-sectional area $A_M$ of the mixing chamber 23 corresponds essentially with the sum of the minimum cross-sectional areas $A_D$ of the channels 22. The smallest diameter d of the channel 13 for the nebulising material at the outlet opening 14 amounts to approximately 55% to 85%, preferably 60% to 70% of the diameter D of the mixing chamber 23.

In order on the one hand to ensure a safe fitting and a self-centering of the two members forming the nozzle body by bracing the nozzle insert member and the nozzle receiving member against each other, and on the other hand to favor the energy release of the compressed air to the nebulising material supplied through the channel 13, the angle of the circular-cone shaped contact surface 11 or the complementary receiving surface 21, respectively, should be about 120°. Angles smaller than 120° are not only unfavorable in this connection, but they also lead to problems in the manufacture and cleaning of the nozzle body (burr formation at the outlet in the nozzle insert member with injection molding production, danger of damage of the edge of the hole in the nozzle insert member, poorer accessibility of the mixing chamber during cleaning).

Although the channels 22 for the compressed air can also be formed in the contact surface 11 of the nozzle insert member 1, contrary to the described embodiment, the above-described embodiment is preferable, since the danger of a mechanical damaging of the channels, especially in the region of the mixing chamber 23, is reduced. Furthermore, the cross-sectional form of the channels 22 for the compressed air is not restricted to a rectangular form or the form of an equal-sided trapezoid. In view of a simple injection molding production, the described cross-sectional forms are advantageous and are also especially suitable with respect to the reduction of the cross-section towards the center of the nozzle body, which serves to accelerate the compressed air with the increase of kinetic energy.

In the described embodiment of the nebuliser nozzle according to the invention, three channels 22 for the compressed air are provided in the receiving surface 21. With an approximately quadratic cross-section of the air channel 22 in the region of the opening into the mixing chamber 23, the influence of manufacturing deviations on the cross-sectional dimension are the smallest. The channel depth should be approximately half the length of the mixing chamber. From geometrical considerations and in view of the possible manufacturing precision with injection production, the number of three channels for the supply of compressed air appears to be optimal. An uneven number of channels for the compressed air, especially three channels in 120° arrangement, stabilizes and centers the emerging aerosol after exit from the nebuliser nozzle. A tangential arrangement of the channels 21 in relation to the mixing chamber 23 can also have a supporting effect here. However, considerations with respect to manufacturing techniques give cause to believe that this configuration is difficult to realize. Furthermore, a flat configuration of the channels 22 for the compressed air is preferable, since thus the cleaning is simplified not only for the channels, but also for the mixing chamber. The channel 13 for the nebulising material in the nozzle insert member 1 can be cleaned with a wire or a nylon cord.

Since with the supply of compressed air into the mixing chamber 23 an overpressure results there, the nebulising material must be added through the channel 13 in the nozzle insert member 1 under pressure. This offers the possibility to vary the ratio of the mass flows via the amount of nebulising material supplied. In practice, arbitrary amounts of the nebulising material can be nebulised since a much larger amount (>250 μl/min) than the amount of up to 50 μl/min expedient for therapeutical purposes can be supplied. With an air flow rate of 4.5 to 5 l/min and a pressure difference of 2 bar, the therapeutically expedient amount can also be desiccated without any problem. Thus particles of the primary aerosol having a diameter of up to 16 μm can be reduced in size alone by the desiccation to the extent that an aerosol is produced by the nebuliser nozzle according to the invention without any further treatments, which contains 100% respirable particles.

The advantages of the nebuliser nozzle according to the invention lie in the simple manufacturing ability (mass produced articles), simple assembly (easy cleaning), the dosing possibility of the liquid phase (different prescriptions), fine primary droplet spectrum (relatively high initial concentration of the medicament solution possible, i.e. short inhalation periods) and in the low pneumatic power requirement ($\Delta p<2$ bar, air volume flow<5 l/min, i.e. compressor operation possible, home therapy).

In the following the results of tests are shown which were carried out on different configurations of nebuliser nozzles of the construction according to the invention.

In this respect, it is firstly to be determined that the air flow rate of the examined nebuliser nozzles increases with the pressure difference and the hole diameter of the nozzle receiving member, i.e. the diameter of the mixing chamber 23. Proceeding from a nozzle insert member 1 having an outlet opening 14 of 0.30 mm (d 0.30), combined with a nozzle receiving member 2 with a mixing chamber 23 of 0.40 mm diameter (D 0.40), the average droplet diameter firstly decreases with increasing mixing chamber diameter with constant pressure, proceeds through a minimum and subsequently increases slightly. An optimum is reached with the combination d 0.30/D 0.45. This behaviour can be explained on account of the energy conditions in the mixing chamber 23.

In all three nozzle receiving members, the channel dimensions are the same. The liquid is conveyed with constant volumetric flow through a hole of 0.30 mm diameter into the mixing chamber 23. With a mixing chamber diameter D of 0.40 mm, its free cross-section is smaller than the sum of the free cross-sections of the channels 22 at the mixing chamber entrance. Damming up of the compressed air results in the mixing chamber 23. With a larger diameter of the mixing chamber 23, about 0.50 mm, the distance between the channel opening and the liquid outlet 14 is larger than in the case of a smaller mixing chamber diameter. The compressed air can relax too soon. In both cases, with too small or too large a mixing chamber diameter D, the delivery of the kinetic energy of the compressed air to the liquid is negatively influenced and thus the dispersion efficiency is poorer.

When plotting the average droplet diameter over the pneumatic performance which is defined as the product of the pressure difference Δp and the air flow rate V, both nozzle bodies, d 0.30/D 0.45 and d 0.30/D 0.40 reveal the same performance efficiency. The primary droplet spectrum requires for the desiccation a defined amount of dispersion air. The nozzle body 0.30/DK 0.45 is therefore better suited, since a constant liquid flow in a spray with a certain average droplet diameter with higher air flow rate and lower pressure difference is dispersed therewith.

The dispersion efficiency of the nozzle body d 0.30/D 0.45 is independent of liquid flows up to 250 μl/min. On account of the air jet deflection and the air jet acceleration, certain shearing forces corresponding to an operating point prevail in the mixing chamber. These shearing forces act against the surfaces on the liquid droplets. The surface force depends on the droplet diameter. Thus, a certain shearing force corresponds with a certain droplet diameter below which the droplet cannot be further reduced in size. For the dispersion of the liquid, a certain portion of energy corresponding with the amount of liquid is taken from the compressed air. The remainder serves for transport or dissipates. With larger liquid flows, the compressed air can release more dispersion energy. However, on account of the necessary desiccation, only smaller liquid flows dependent on the air flow rate are expedient.

The choice of the operating point of a nozzle can be made on the basis of the plotting of the product of the average droplet diameter and the air flow rate over the pressure difference. This criterium also serves for choosing a suitable compressor for home therapy. The optimal operating point corresponds with the minimum in the course of this function. The liquid flow and the medicament concentration must then be adapted to the air flow rate in the operating point. For short inhalation periods, high liquid flow rates with high medicament concentration are necessary, which require high air flow rates and fine primary droplet dispersions. The nozzle is operated at higher pressures than according to the ascertained energetic optimum.

I claim:

1. A nebulizer for inhalation therapy, comprising:

a housing;

a nebulizer nozzle body in the housing for nebulizing a material to be nebulized for inhalation therapy, the housing being adapted to supply the material to be nebulized and compressed gas to the nozzle body, the nozzle body comprising:

a nozzle insert member having a contact surface and a passage for supply of material to be nebulized extending in a longitudinal direction through the nozzle insert member, the passage having an outlet disposed in the center of the contact surface; and a nozzle receiving member for receiving the nozzle insert member, having a receiving surface that is complementary to the contact surface of the nozzle insert member, the contact surface engaging the receiving surface, the receiving surface being interrupted by a plurality of radially-extending grooves, the grooves being closed by the corresponding portions of the contact surface to form compressed gas supply channels for supplying gas to nebulize the material to be nebulized, a circular cylindrical mixing chamber having a mouth being disposed at the center of the receiving surface and extending through the nozzle receiving member, with the supply channels and the passage outlet opening into the mixing chamber, wherein the sum of the minimum cross sectional areas of the supply channels is approximately equal to the cross sectional area of the mouth of the mixing chamber.

2. The nebulizer of claim 1, wherein the diameter of the mixing chamber is approximately equal to the length of the mixing chamber.

3. The nebulizer of claim 1, wherein the supply channels are rectangular or trapezoidal in cross sectional configuration.

4. The nebulizer of claim 3, wherein the supply channels are trapezoidal in cross sectional configuration and have sidewalls that are inclined at an angle of 3 to 15 degrees from perpendicular with respect to the channel floor.

5. The nebulizer of claim 1, wherein the supply channels have a tapering cross sectional area that decreases in the direction of the mixing chamber.

6. The nebulizer of claim 1, wherein the passage outlet is of circular cross section and has a diameter that is about 55% to 85% of the diameter of the mixing chamber.

7. The nebulizer of claim 6, wherein the diameter of the passage outlet is about 60% to 70% of the diameter of the mixing chamber.

8. The nebulizer of claim 7, wherein the diameter of the passage outlet is 0.3 mm and the diameter of the mixing chamber is 0.45 mm.

9. The nebulizer of claim 1, wherein the nozzle insert member and the nozzle receiving member are both of a generally circular cylindrical configuration and the contact surface and the receiving surface have circular conical shapes of the same slope.

10. The nebulizer of claim 9, wherein the receiving surface has three grooves spaced 120 degrees apart.

11. The nebulizer of claim 10, wherein the nozzle insert member is defined by two flat circular cylinders of different diameter and a circular cone, all arranged coaxially, the flat circular cylinder of smaller diameter being disposed between the flat circular cylinder of larger diameter and the circular cone, the housing comprising a circular cylindrical member in which the nozzle insert member and the nozzle receiving member are disposed, the circular cylindrical member having an inner diameter that is substantially equal to the diameter of the larger flat circular cylinder, whereby an annular space for supplying compressed gas to the supply channels is defined between the flat circular cylinder of smaller diameter and the circular cylindrical member of the housing.

12. The nebulizer of claim 11, wherein the flat circular cylinder of larger diameter has a partially flattened periphery, thereby defining a space between the flat circular cylinder of larger diameter and the circular cylindrical member of the housing for supplying compressed gas to the annular space.

13. The nebulizer of claim 9, wherein the circular cone has an angle of 100 to 140 degrees.

14. The nebulizer of claim 13, wherein the angle is 120 degrees.

15. The nebulizer of claim 11, wherein the housing further comprises a lid member, the lid member having a first passage for supplying material to be nebulized to an inlet of the passage of the nozzle insert member and a second passage for supplying compressed gas to the interior of the housing, the lid member being sealed against the nozzle insert member to prevent compressed gas from the second passage from having access to the inlet of the passage of the nozzle insert member.

* * * * *